US006558176B1

(12) United States Patent
Martin et al.

(10) Patent No.: US 6,558,176 B1
(45) Date of Patent: May 6, 2003

(54) MATE ASSIST ASSEMBLY FOR CONNECTING ELECTRICAL CONTACTS

(75) Inventors: Galen M. Martin, Camp Hill, PA (US); Keith R. Foltz, Oberlin, PA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 10/093,345

(22) Filed: Mar. 7, 2002

(51) Int. Cl.[7] ..... H01R 13/62
(52) U.S. Cl. ..... 439/157; 439/372
(58) Field of Search ..... 439/157, 372, 439/152, 160, 153, 154, 155, 310, 341–343

(56) References Cited

U.S. PATENT DOCUMENTS 5,322,448 A * 6/1994 Hahn ..... 439/157
5,593,309 A 1/1997 Post et al. ..... 439/157
5,722,843 A * 3/1998 Kerkhof et al. ..... 439/157
5,785,558 A 7/1998 Post et al. ..... 439/680
5,829,994 A * 11/1998 Oda et al. ..... 439/157
5,833,484 A 11/1998 Post et al. ..... 439/352
6,039,586 A * 3/2000 Kitamura ..... 439/157
6,099,330 A 8/2000 Gundermann et al. ..... 439/157
6,186,804 B1 * 2/2001 Smith et al. ..... 439/157
6,312,272 B1 * 11/2001 Gaupp et al. ..... 439/157
6,312,273 B1 * 11/2001 Hasegawa et al. ..... 439/157
6,325,647 B1 * 12/2001 May et al. ..... 439/157
6,368,125 B1 * 4/2002 Gundermann et al. ..... 439/157

* cited by examiner

*Primary Examiner*—P. Austin Bradley
*Assistant Examiner*—Ross Gushi

(57) ABSTRACT

An electrical connector is provided including first and second housings configured to be matable with one another to join electrical contacts. The first and second housings are movable between initial and final positions, at which the electrical contacts partially and fully mate, respectively. The electrical connector includes a lever member that engages the first and second housings, moving the first and second housings between the initial and final positions. The lever member includes a cam arm having first, second, and third gear surfaces. The second housing includes first and second mating posts that are configured to engage the first, second, and third gear surfaces at first, second, and third distances, respectively, from the rotational axis as the lever member rotates through a range of motions to move the first and second housings between the initial and final positions. The first, second, and third distances are all different.

24 Claims, 11 Drawing Sheets

MATE ASSIST ASSEMBLY FOR CONNECTING ELECTRICAL CONTACTS

BACKGROUND OF THE INVENTION

Certain embodiments of the present invention generally relate to a lever-based connection assembly for engaging resisting components. More particularly, certain embodiments of the present invention relate to a mate assist assembly for connecting electrical contacts contained in separate housings.

In certain applications, electronic components require the mating of several electrical contacts, such as in automotive electrical components. The electronic component includes a connector housing that holds several electrical contacts, while a mating connector housing holds an equal number of electrical contacts. One connector housing includes male electrical contacts, while the other connector housing includes female electrical contacts. As the number of electrical contacts to be mated increases, it becomes difficult to fully join the mating connector housings because of friction between the mating electrical contacts. The connector housings are formed with a mate assist assembly that includes a lever-and-gear system to pull together the connector housings in order to overcome the frictional resistance created by the mating electrical contacts.

A mate assist assembly is described in U.S. Pat. No. 5,833,484 issued to Post that includes a lever, and first and second connector housings including electrical contacts. The first connector housing is configured to be positioned inside the second connector housing. The lever includes a handle and two arms that extend from, and may be rotated alongside, end walls of the first connector housing. The second connector housing may be slid onto and enclose the first connector housing and the lever arms to a point where the electrical contacts resist further insertion. Each lever arm includes a cam arm with gear teeth. Racks are situated within the second connector housing with each rack corresponding to the gear teeth of one of the cam arms.

As the handle is rotated upward, the racks and cam arms engage and pull the first connector housing and lever downward into the second connector housing, mating the electrical contacts. Alternatively, as the handle is rotated downward, the first connector housing is pulled upward out of the second connector housing, unmating the electrical contacts.

The conventional mate assist assembly suffers from certain drawbacks. First, the cam arms are manufactured by the injection molding process which is difficult and time-consuming to perform when used to make a piece with many small parts such as the gear teeth. The multiple gear teeth are also difficult to manufacture by injection molding. Secondly, the gear teeth do not generate a strong unmating force upon first engaging the racks. Thus the static friction of the connected contacts is difficult to overcome. Therefore, a need exists for a mate assist assembly that overcomes the above problems and addresses other concerns experienced in the prior art.

BRIEF SUMMARY OF THE INVENTION

Certain embodiments of the present invention include an electrical connector assembly having first and second housings. The first and second housings have ends configured to receive electrical contacts and have front ends configured to be matable with one another to join corresponding electrical contacts. The first and second housings are movable between initial and final positions, at which the corresponding electrical contacts partially and fully mate.

The electrical connector assembly includes a lever member that engages the first and second housings and moves the first and second housings between the initial and final position as the lever member is rotated through a range of motion about a rotational axis. The lever member includes at least one cam arm that has a retention aperture to engage the first housing and that has first and second gear surfaces configured to engage the second housing.

The electrical connector assembly includes first and second mating posts mounted within an interior region of the second housing. The first mating post engages the first gear surface at a first distance from the rotational axis as the lever member is rotating through the range of motion to move the first and second housings toward the final position. The second mating post engages the second gear surface at a second distance from the rotational axis as the lever is rotating an opposite direction through the range of motion to move the first and second housings toward the initial position. The first and the second distances are different.

Certain other embodiments include an electrical connector assembly having first and second housings. The first and second housings have ends configured to receive electrical contacts and have front ends configured to be matable with one another to join corresponding electrical contacts. The first and second housings are movable between initial and final positions, at which the corresponding electrical contacts partially and fully mate, respectively.

The electrical connector assembly also includes a lever member that engages the first and second housings and moves the first and second housings between the initial and final positions as the lever member is rotated through a range of motion about a rotational axis. The lever member includes at least one cam arm having a retention aperture to engage the first housing and first and second unmating surfaces configured to engage the second housing.

The electrical connector assembly also includes first and second mating posts mounted within an interior region of the second housing. The first mating post is configured to engage the first unmating surface a first distance from the rotational axis as the lever member is rotating through the range of motion to move the first and second housings to the initial position. The second mating post is configured to engage the second unmating surface a second distance from the rotational axis as the lever is rotating through the range of motion to move the first and second housings to the initial position. The first and second distances are different.

Figure 1:
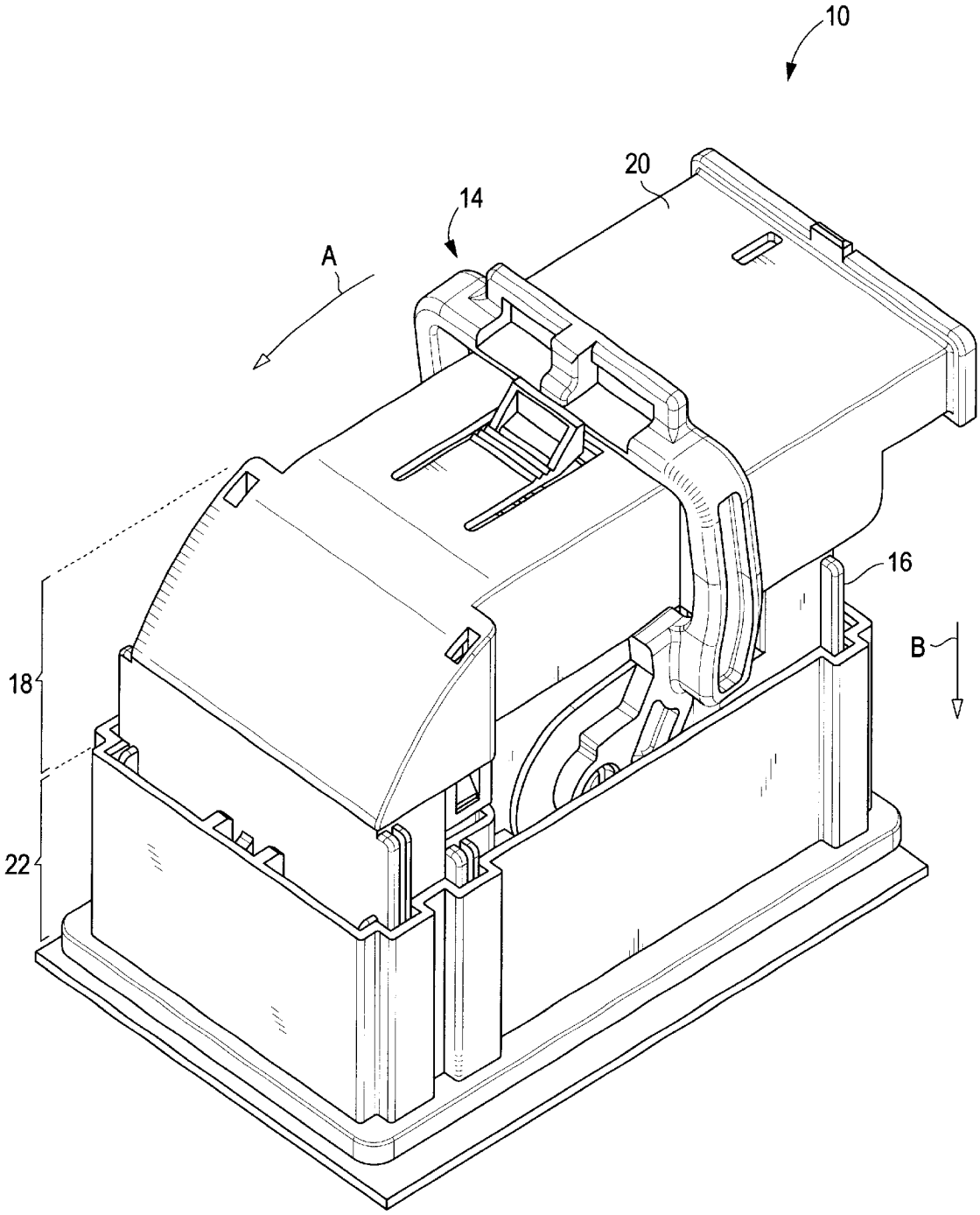
FIG. 1 illustrates a top isometric view of a mate assist assembly according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 8:
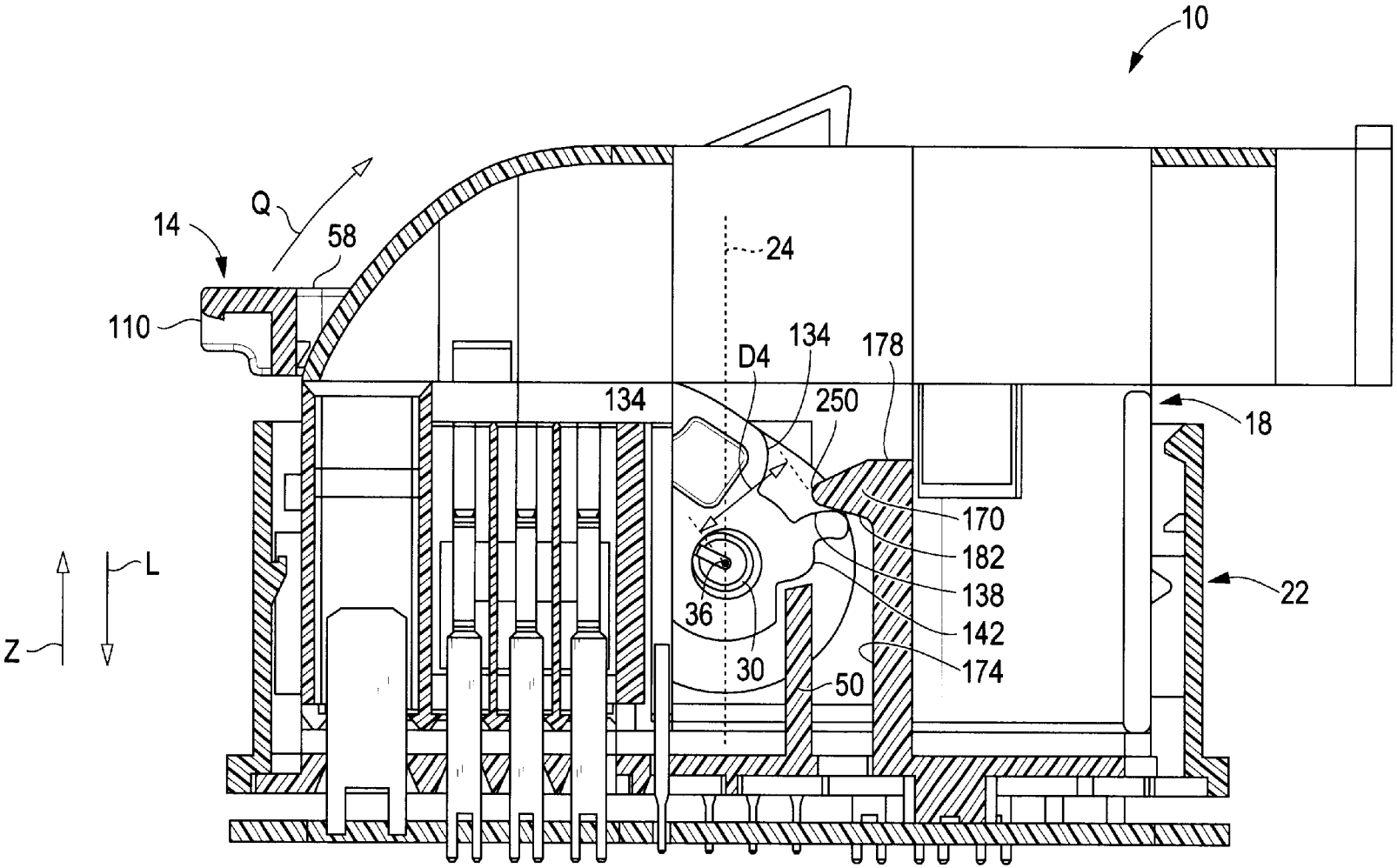
FIG. 8 illustrates a cutaway side view of the mate assist assembly of FIG. 1 in the final position.

FIG. 1 illustrates a top isometric view of a mate assist assembly 10 according to an embodiment of the present invention. The mate assist assembly 10 includes a harness connector 18 having a bottom portion 16 and a top portion 20. The bottom portion 16 is configured to receive packets that hold groups of electrical contacts while the top portion 20 covers the electrical contacts. A module connector 22 holds electrical contacts configured to mate with the electrical contacts in the harness connector 18. The harness connector 18 is partially inserted within the module connector 22 to an initial staging position. A lever member 14 is retained on the exterior of the harness connector 18 and engages the module connector 22. The lever member 14 is rotatable in the direction of arrow A from the initial staging position (FIG. 1) to a final position (FIG. 8). As the lever member 14 is rotated, it pushes the harness connector 18 downward in the direction of arrow B into the module connector 22 and fully mates the electrical contacts of the harness connector 18 and the module connector 22 with each other.

Figure 2:
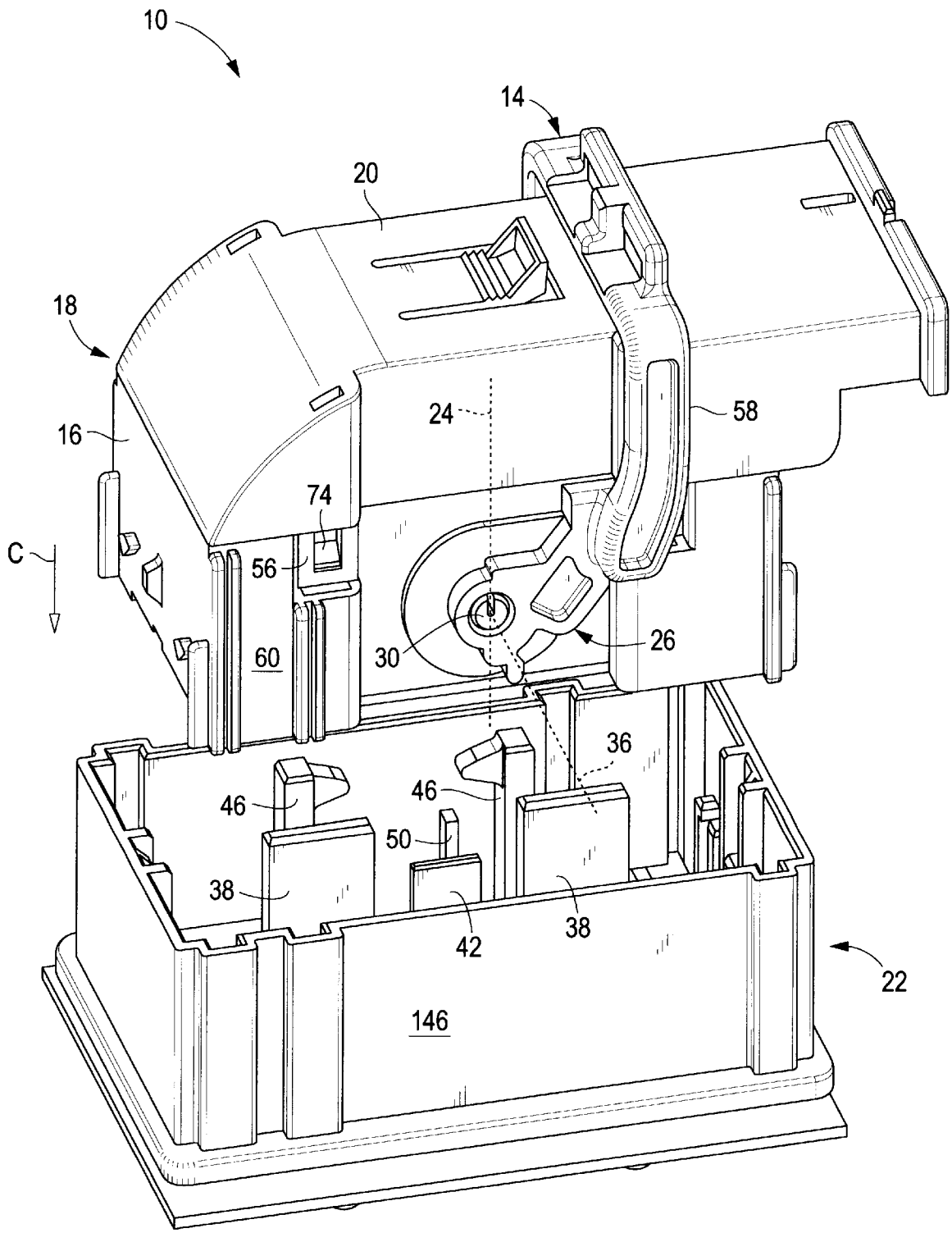
FIG. 2 illustrates an exploded isometric view of the mate assist assembly of FIG. 1.

FIG. 2 illustrates an exploded isometric view of the mate assist assembly 10 of FIG. 1. The lever member 14 includes cam arms 26 that rotate about pivot posts 30 extending outward from the harness connector 18 along a rotational axis 36. The lever member 14 is oriented in an unmated position with lever arms 58 aligned generally parallel to a vertical axis 24. The module connector 22 includes large alignment posts 38 and a small alignment post 42 formed in the center of the module connector 22. The module connector 22 also includes mating posts 46 facing each other and located alongside side walls 146. Release posts 50 (only one shown) are positioned between the mating posts 46.

The top portion 20 and the bottom portion 16 of the harness connector 18 are fastened together by retention latches 56 extending from the top portion 20 and engaging latch catches 74 extending from side walls 60 of the bottom portion 16. The harness connector 18 and the lever member 14 are removably inserted downward in the direction of arrow C into the module connector 22 into the initial staging position shown in FIG. 1. When the harness connector 18 is in the initial staging position, each cam arm 26 is positioned between a pair of opposing mating posts 46 and above a pair of release posts 50, and the harness connector 18 slidably receives the alignment posts 38 and 42 within alignment recesses (not shown) located inside the harness connector 18.

Figure 3:
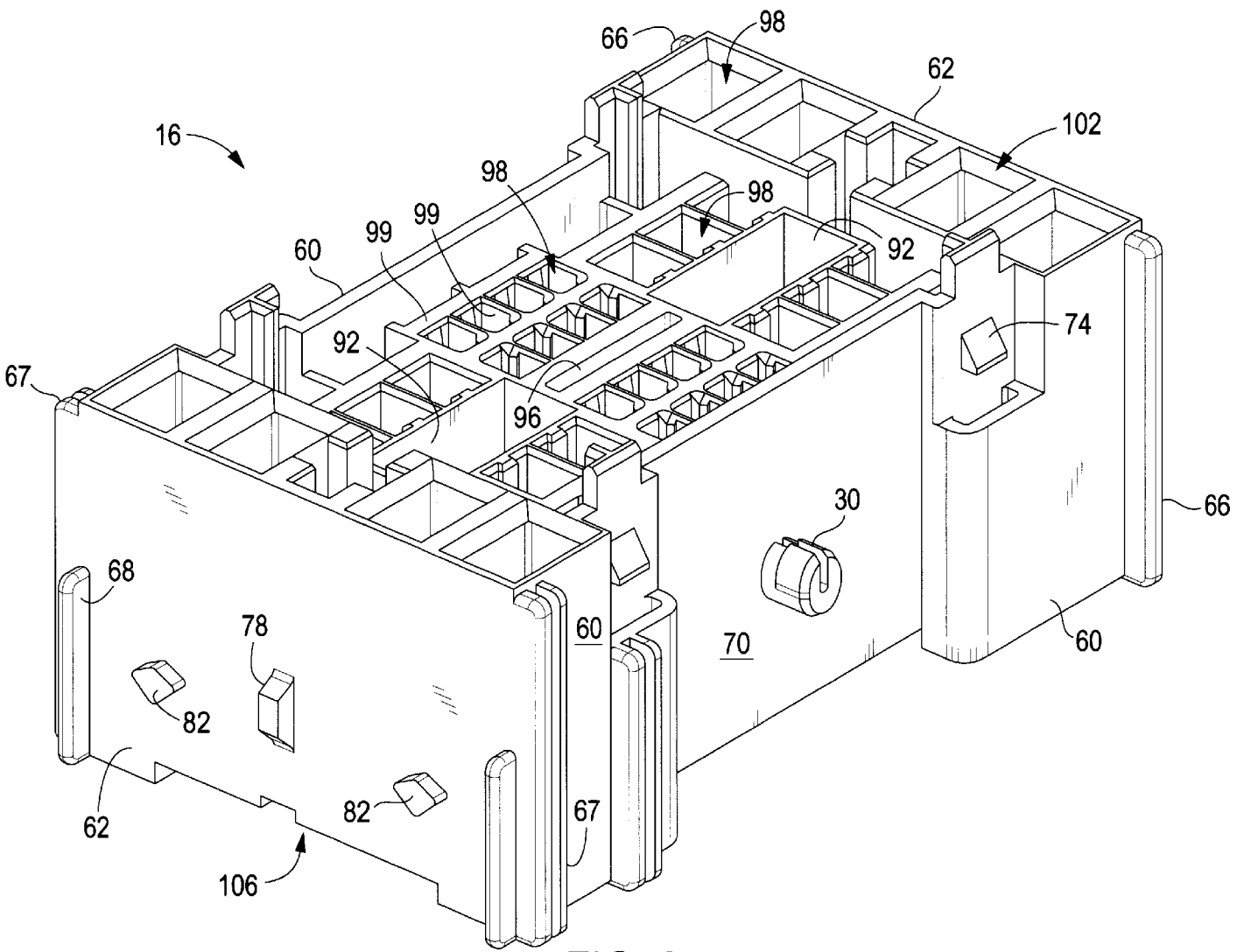
FIG. 3 illustrates an isometric view of the bottom portion of the harness connector of FIGS. 1 and 2.

FIG. 3 illustrates an isometric view of the bottom portion 16 of the harness connector 18 of FIGS. 1 and 2. The bottom portion 16 is box shaped and includes the opposing side walls 60 and opposing end walls 62. A perimeter around the exterior of the bottom portion 16 is smaller than an interior perimeter of the module connector 22 of FIGS. 1 and 2, in order that the harness connector 18 may be positioned within the module connector 22.

Securing rails 66 and 67 extend outward from opposite ends of the side walls 60. Double securing rails 67 are located on opposite sides at one end of the bottom portion 16 and a single securing rail 67 is located on opposite sides of an opposite end of the bottom portion 16. The securing rails 66 and 67 are slidably received by cavities 100 (FIG. 5) within the module connector 22 so that the bottom portion 16 does not slide transversely to the securing rails 66 and 67 within the module connector 22. The pivot posts 30 extend outward from the centers of recessed portions 70 of the side walls 60. Each cam arm 26 (FIG. 2) encloses and rotates about a pivot post 30 along a recessed portion 70. When the harness connector 18 is positioned within the module connector 22, the cam arms 26 are rotatable within a chamber defined by the recessed portion 70 and the module connector 22. The side walls 60 also include the triangular latch catches 74 that snapably engage the retention latches 56 formed with the top portion 20.

Short securing rails 68 extend outward from the end walls 62 proximate opposite corners of the end walls 62. The short securing rails 68 are slidably received within the module connector 22 and engage end walls 150 (FIG. 5) of the module connector 22. Each end wall 62 also includes a retention wedge 78 located between two diamond shaped retention beams 82. The retention wedges 78 are received by retention channels 86 (FIG. 5) in the module connector 22 and snapably engage wedge catches 90 (FIG. 5) positioned within the retention channels 86. The retention beams 82 likewise snapably engage beam catches 94 (FIG. 5) positioned within the module connector 22. As the bottom portion 16 is inserted into the module connector 22, the retention wedges 78 and retention beams 82 slide past the wedge catches 90 and beam catches 94, respectively, so that the bottom portion 16 is retained within the module connector 22.

The bottom portion 16 includes several connector pockets 98 of varying shapes and sizes formed with walls 99 extending from the side and end walls 60 and 62. The connector pockets 98 extend throughout the harness connector 16 from an open top section 102 to an open bottom section 106. The connector pockets 98 hold the electrical contacts that are mated with the electrical contacts contained within the module connector 22. Centered within the bottom portion 16 between sets of connector packets 98 is a small alignment recess 96 situated between large alignment recesses 92. The small and large alignment recesses 96 and 92 extend through the harness connector 16 and receive and enclose the small and large alignment posts 42 and 38 (FIG. 2) mounted in the module connector 22 when the harness connector 18 is positioned within the module connector 22.

Figure 4:
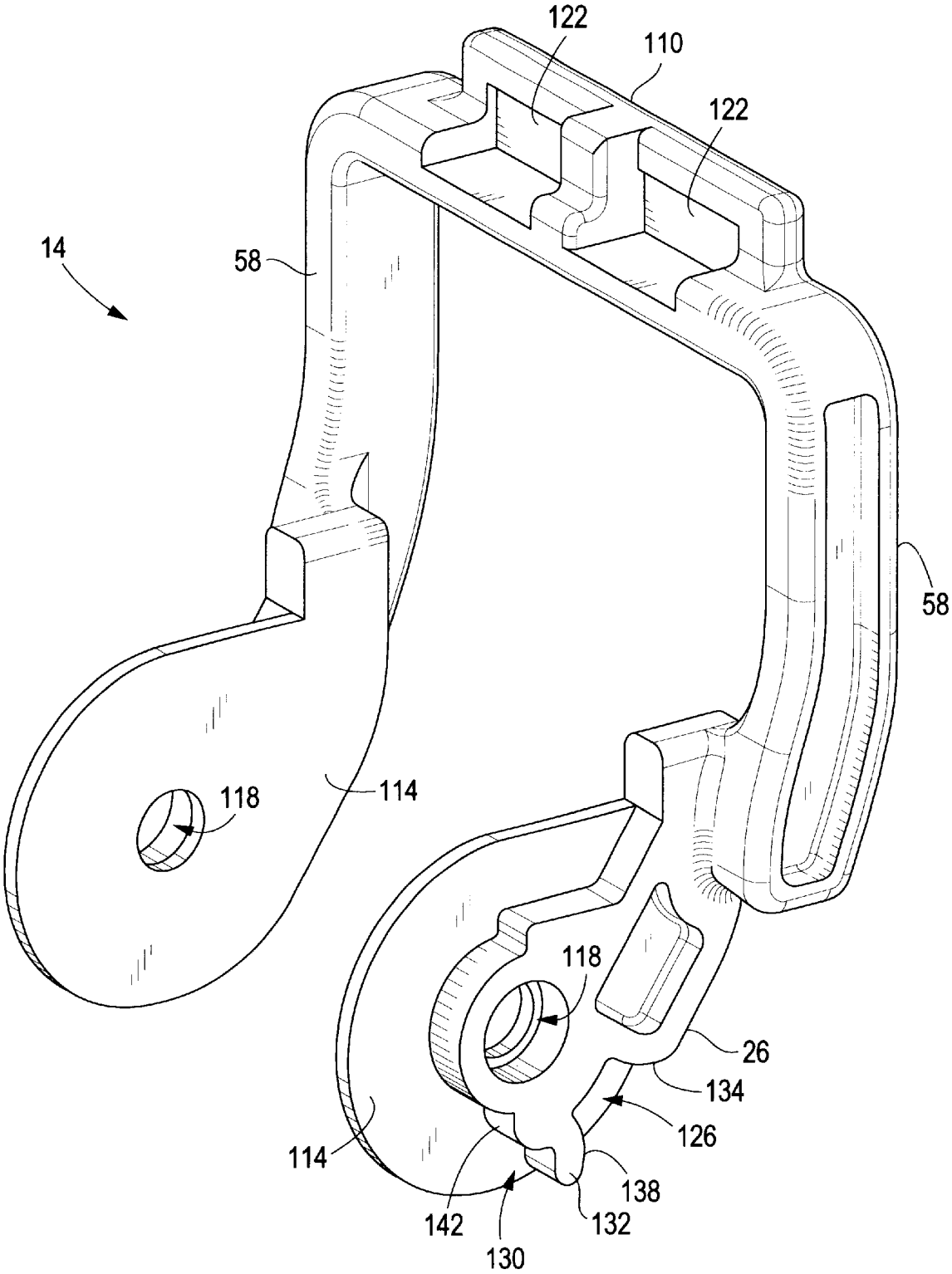
FIG. 4 illustrates an isometric view of the lever member according to an embodiment of the present invention.

FIG. 4 illustrates an isometric view of the lever member 14 of FIGS. 1 and 2 in more detail. A handle 110 is formed integral with, and extends perpendicularly between, the lever arms 58, which are in turn formed with the cam arms 26. Circular contact bases 114 extend along the insides of the cam arms 26, and retention apertures 118 extend through the cam arms 26 and contact bases 114. The lever member 14 is attached to the harness connector 18 by deflecting the lever arms 58 outward away from each other so that the contact bases 114 slide along the pivot posts 30 (FIG. 2) until the pivot posts 30 are enclosed within the retention apertures 118. The lever member 14 is then rotatable about the rotational axis 36 with the contact bases 114 slidably engaging the recessed portions 70 (FIG. 3) of the harness connector 18. The handle 110 includes two grip surfaces 122 that an operator may use to rotate the lever member 14.

Each cam arm 26 includes a first notch 126 adjacent to a second notch 130 along a gear tooth 132 formed in the peripheral surface of the cam arm 26. The first notch 126 includes a first ungearing surface 134 located across from a gearing surface 138 on the gear tooth 132. When the lever member 14 is rotated to move the mate assist assembly 10 from the initial staging position to the final position (as shown in FIG. 8), the gearing surfaces 138 engage the mating posts 46 (FIG. 2) as described below. Alternatively, when the lever member is rotated to move the mate assist assembly 10 from the final position to the initial staging position, the first ungearing surfaces 134 engage the mating posts 46 as described below.

The second notch 130 of each cam arm 26 is partially defined by a second ungearing surface 142. When the lever member 14 is rotated to move the mate assist assembly 10 from the final position to the initial staging position, the second ungearing surfaces 142 engage the release posts 50 (FIG. 2) situated alongside the mating posts 46 as described below.

Figure 5:
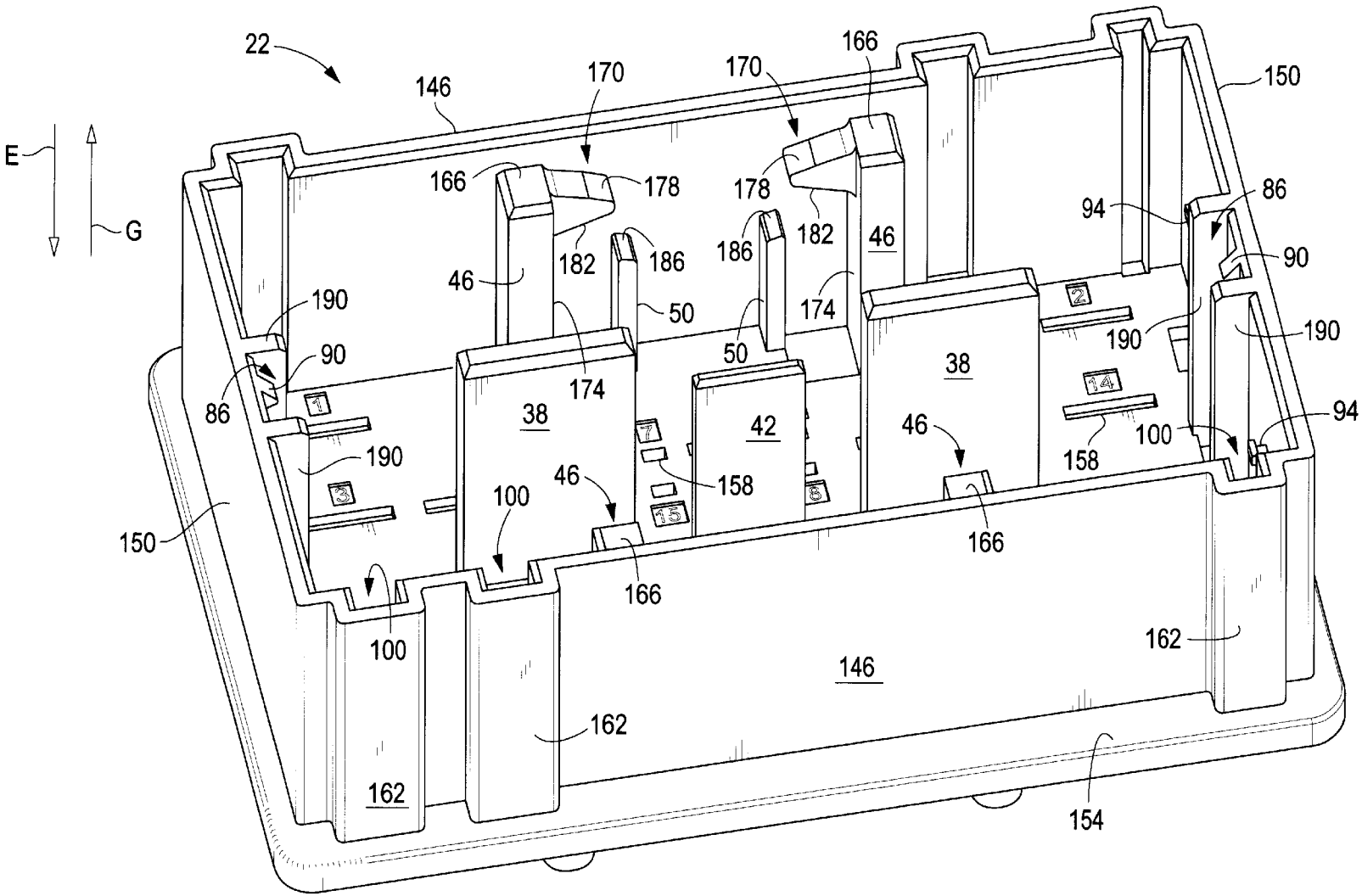
FIG. 5 illustrates an isometric view of the module connector according to an embodiment of the present invention.

FIG. 5 illustrates an isometric view of the module connector 22 of FIGS. 1 and 2. The two side walls 146 are formed integral with, and are aligned perpendicular to, the end walls 150. The side and end walls 146 and 150 are formed integral with, and extend from, a base 154, which has a larger perimeter than a perimeter about the side and end walls 146 and 150. The base 154 is mounted to an electronic component (not shown), such as a radio, with the side and end walls 146 and 150 extending outward from the electronic component. Several contact slots 158 of varying sizes and shapes extend through the base 154. The electrical contacts positioned within the module connector 22 are connected to the electronic component through the contact slots 158. The large alignment posts 38 and small alignment post 42 extend upward from the center of the base 154.

The side walls 146 each include rail chambers 162 along the exteriors of the side walls 146 that define cavities 100 along the interiors of the side walls 146. The rail chambers 162 are appropriately situated along each side wall 146 so that when the harness connector 18 is positioned within the module connector 22, the cavities 100 receive corresponding securing rails 66 and 67 situated on the side walls 60 of the harness connector 18 (FIG. 4). Thus the rail chambers 162 retain the securing rails 66 and 67 and guide the harness connector 18 into the module connector 22 in the proper orientation.

The mating posts 46 and the release posts 50 extend inward from the side walls 146 along the base 154. Two mating posts 46 extending from one side wall 146 face each other and are oriented opposite two mating posts 46 extending from the other side wall 146. Similarly, two release posts 50 extend from one side wall 146 between the mating posts 46 oriented opposite two release posts 50 extending from the other side wall 146. Each side wall 146 includes mating posts 46 and release posts 50 so that the lever member 14 and the top portion 20 (FIG. 2) of the harness connector 18 may be connected to the bottom portion 16 in either one of two orientations with each cam arm 26 still engaging a mating post 46 and a release post 50 when the harness connector 18 is inside the module connector 22.

The mating posts 46 are rectangular in shape and include flat top surfaces 166. A wedge shaped tooth 170 extends from an inside wall 174 of each mating post 46 proximate the top surface 166. The tooth 170 includes a top portion 178 that extends downward at an acute angle from the top surface 166 to a bottom portion 182 that extends upward from, and at an obtuse angle to, the inside wall 174. In operation, when the cam arms 26 (FIG. 4) are rotated to move the mate assist assembly 10 from the initial staging position to the final position, the gearing surfaces 138 (FIG. 4) engage, and are resisted by, the bottom portions 182, pulling the cam arms 26 downward in the direction of arrow E. Alternatively, when the cam arms 26 are rotated to move the mate assist assembly 10 from the final position to the initial staging position, the first ungearing surfaces 134 (FIG. 4) engage, and are resisted by, the top portions 178, pushing the cam arms 26 upward in the direction of arrow G.

The release posts 50 are rectangular in shape and include flat top surfaces 186 that slope downward in the direction of the other release post 50 along the same side wall 146. In operation, when the cam arms 26 are rotated to move the mate assist assembly 10 from the final position to the initial staging position, the second ungearing surfaces 142 (FIG. 4) engage, and are resisted by, the top surfaces 186, pushing the cam arms 26 upward in the direction of arrow G.

Each end wall 150 includes two guide walls 190 that extend inwardly and perpendicularly from the end wall 150 parallel to each other. The two guide walls 190 and the end wall 150 define the retention channel 86 that receives a retention wedge 78 (FIG. 3). The beam catches 94 extend inward from the end walls 150 alongside the guide walls 190. The wedge catches 90 are centered between the guide walls 190 within the retention channels 86 so that the retention wedges 78 snapably slide downward past, and are retained under, the wedge catches 90 as the harness connector 18 is inserted downward into the module connector 22.

Figure 6:
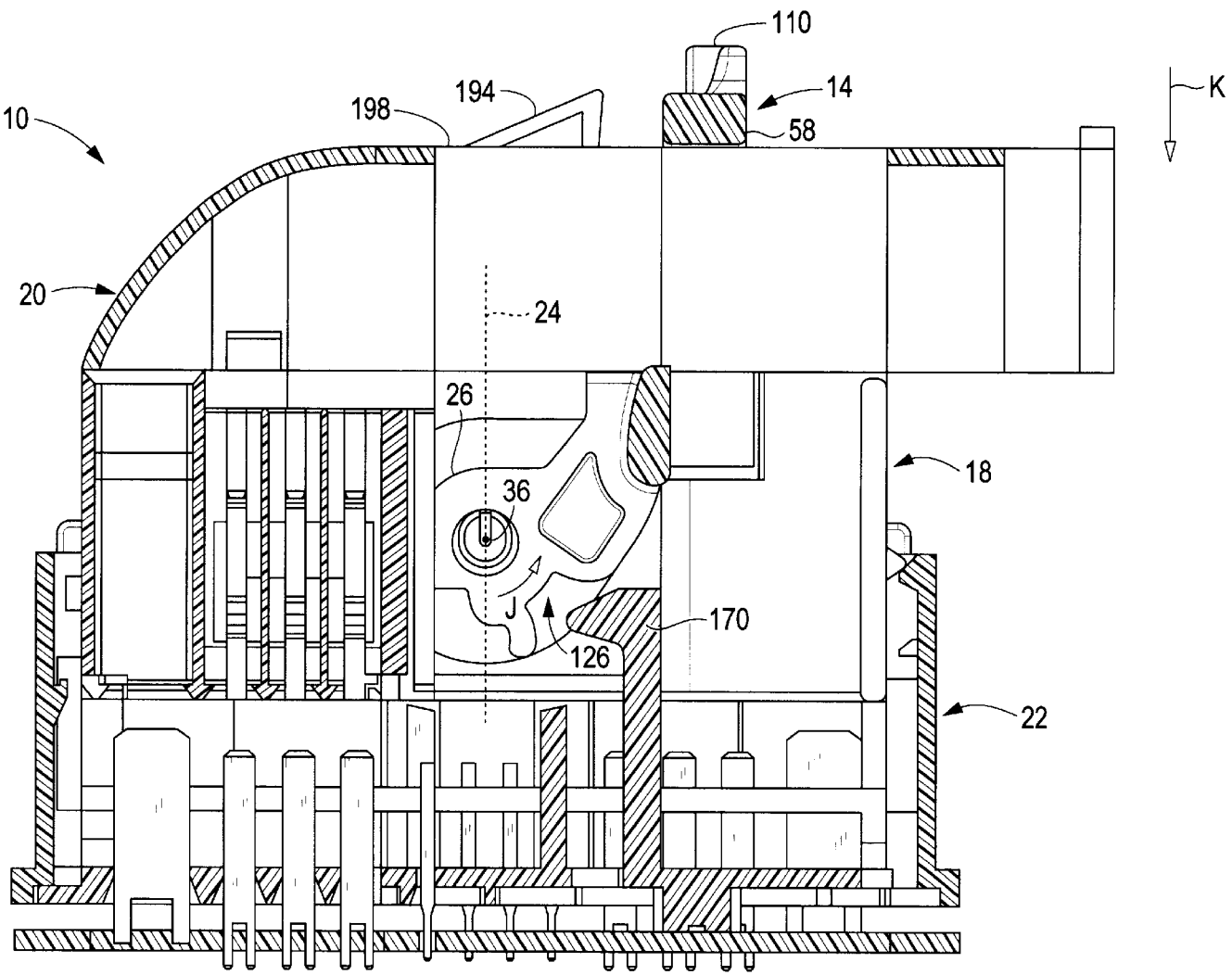
FIG. 6 illustrates a cutaway side view of the mate assist assembly of FIG. 1 in the initial staging position.

FIG. 6 illustrates a cutaway side view of the mate assist assembly 10 of FIG. 1 in the initial staging position. The top portion 20 includes a deflectable stop wedge 194 that extends out of a top surface 198 and is positioned to engage the handle 110 and thus prevent the lever member 14 from being rotated along the rotational axis 36 in the direction of arrow J. The lever arms 58 are parallel with the vertical axis 24 and the teeth 170 are partially situated within the first notches 126 and thus in the rotational path of the cam arms 26. In order to further insert the harness connector 18 within the module connector 22 and mate the electrical contacts, the stop wedge 194 is positioned downward in the direction of arrow K so that the lever member 14 may then be rotated in the direction of arrow J about the retention axis 36 with the handle 110 passing over the deflected stop wedge 194.

Figure 7:
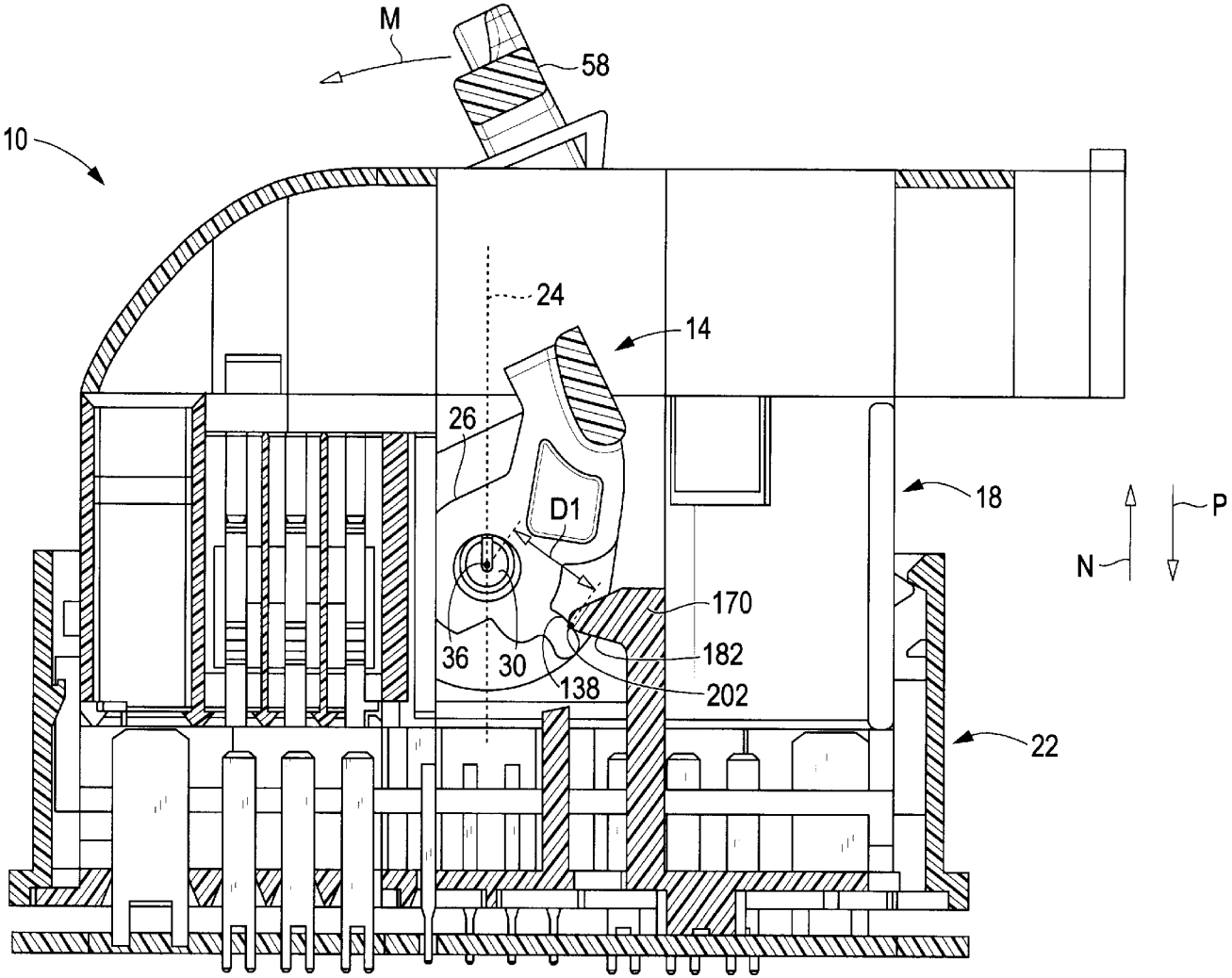
FIG. 7 illustrates a cutaway side view of the mate assist assembly of FIG. 1 in a mating stage.

FIG. 7 illustrates a cutaway side view of the mate assist assembly 10 of FIG. 1 in a mating stage. As shown, the lever arms 58 are at a 25-degree angle to the vertical axis 24 and the gearing surfaces 138 engage the bottom portions 182 of the teeth 170 at a first contact point 202. The first contact point 202 is separated from the rotational axis 36 by a distance, or pitch radius, D1. As the lever member 14 is further rotated about the rotational axis 36 in the direction of arrow M, the bottom portions 182 of the teeth 170 resist the upward motions of the gearing surfaces 138 in the direction of arrow N, causing the cam arms 26 to pull the pivot posts 30, and thus the rotational axis 36, vertically downward in the direction of arrow P. As the pivot posts 30 are pulled downward, the harness connector 18 is in turn pulled downward with enough force to overcome the static and the dynamic friction between the mating electrical contacts and partially connect the electrical contacts.

FIG. 8 illustrates a cutaway side view of the mate assist assembly 10 of FIG. 1 in the final position. The lever arms 58 are horizontal, or at a 90-degree angle to the vertical axis 24. The electrical contacts in the harness connector 18 are fully mated with the electrical contacts in the module connector 22. As the gearing surfaces 138 engaged the bottom portions 182 and the pivot posts 30 moved vertically downward in the direction of arrow L, the gearing surfaces 138 slid along the bottom portions 182 closer to the inside walls 174. To unmate the electrical contacts and return the harness connector 18 to the initial staging position, an operator uses the handle 110 to rotate the lever member 14 in the direction of arrow Q about the rotational axis 36.

Figure 9:
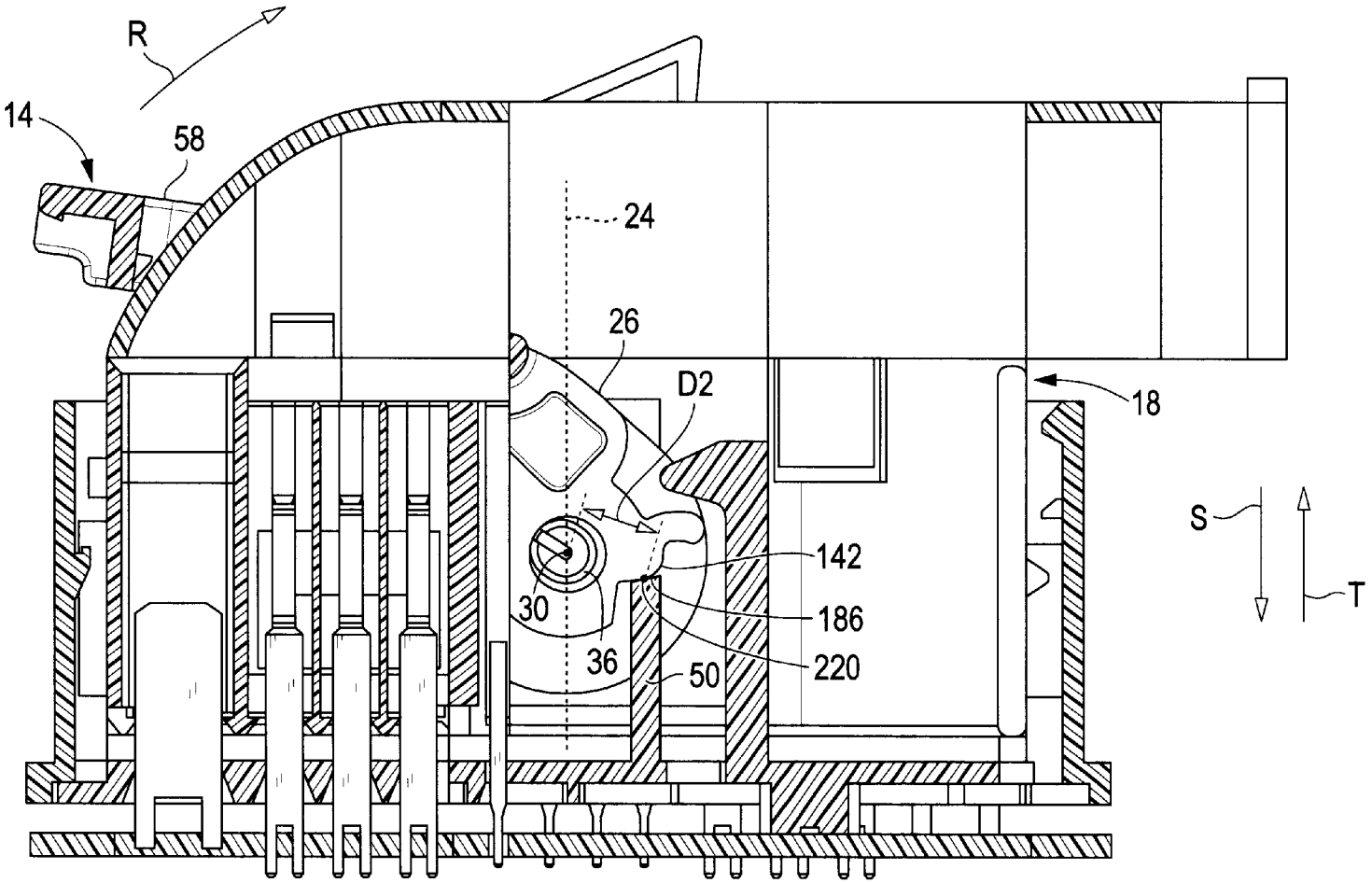
FIG. 9 illustrates a cutaway side view of the mate assist assembly of FIG. 1 in a first unmating stage.

FIG. 9 illustrates a cutaway side view of the mate assist assembly 10 of FIG. 1 in a first unmating stage. The lever arms 58 are at an 80-degree angle to the vertical axis 24 and the second ungearing surfaces 142 engage the top surfaces 186 of the release posts 50 at a first contact point 220. The first contact point 220 is separated from the rotational axis 36 by a distance, or pitch radius, D2, which is different than D1. As the lever member 14 is further rotated about the rotational axis 36 in the direction of arrow R, the top surfaces 186 of the release posts 50 resist the downward motions of the second ungearing surfaces 142 in the direction of arrow S, causing the cam arms 26 to pull the pivot posts 30, and thus the rotational axis 36, vertically upward in the direction of arrow T. As the pivot posts 30 are pulled upward, the harness connector 18 is in turn pulled upward with enough force to overcome the static and the dynamic friction between the mating electrical contacts and thus partially disengage the electrical contacts.

Figure 10:
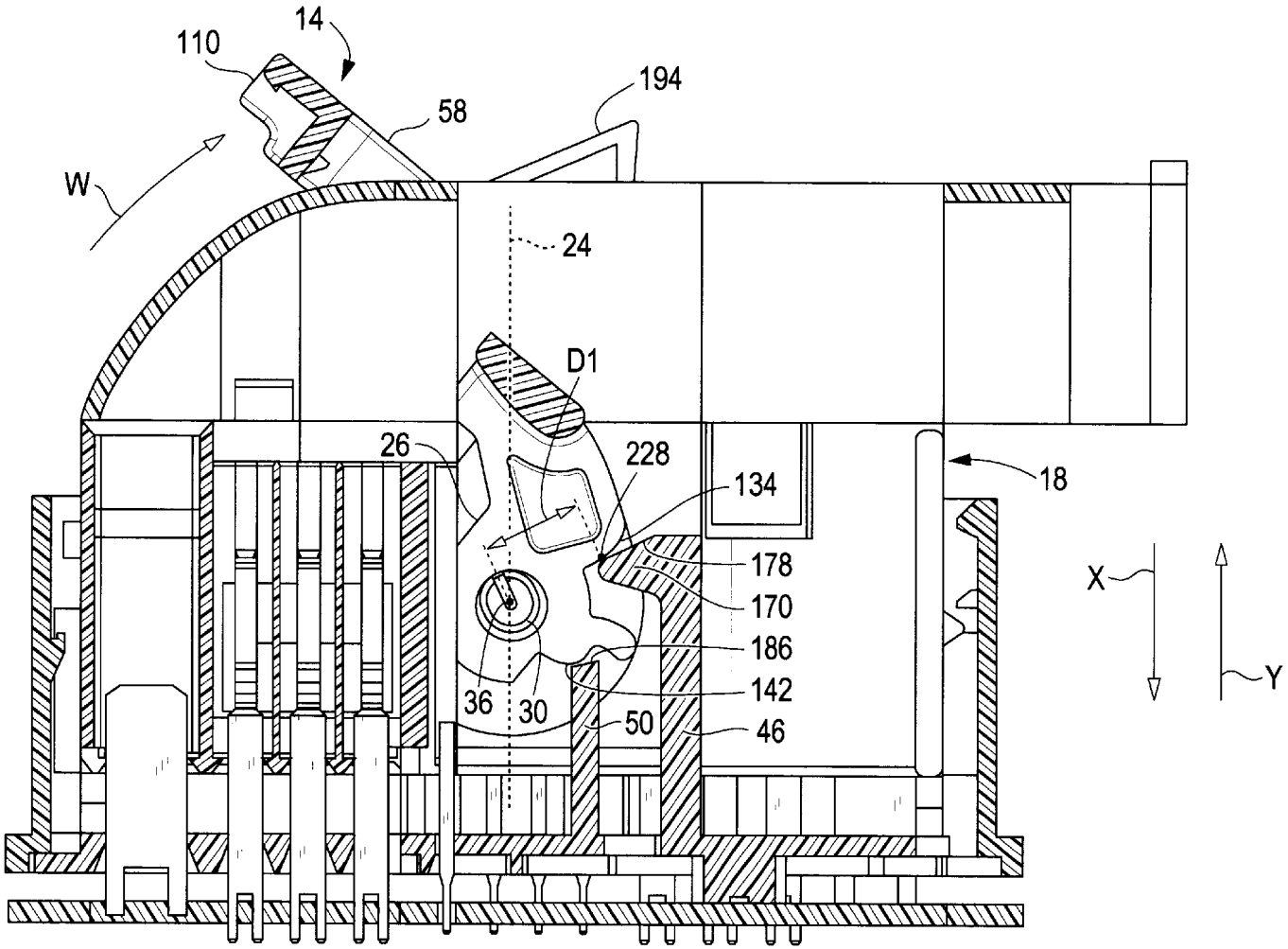
FIG. 10 illustrates a cutaway side view of the mate assist assembly of FIG. 1 in a second unmating stage.

FIG. 10 illustrates a cutaway side view of the mate assist assembly 10 of FIG. 1 in a second unmating stage. The lever arms 58 are at a 50-degree angle to the vertical axis 24. As the second ungearing surfaces 142 engaged the top surfaces 186 and the pivot posts 30 were moved vertically upward in the direction of arrow Y, the second ungearing surfaces 142 slid along the top surfaces 186 toward the mating posts 46.

At the second unmating stage, the pivot posts 30 are positioned above the release posts 50 so that the second ungearing surfaces 142 no longer vertically engage the top surfaces 186 in the downward direction of arrow X and thus no longer produce a vertical vector force to disengage the electrical contents. However, the first ungearing surfaces 134 engage the top portions 178 of the teeth 170 at a first contact point 228. The first contact point 228 is separated from the rotational axis 36 by the distance, or pitch radius, D1. As the lever member 14 is further rotated about the rotational axis 36 in the direction of arrow W, the top portions 178 of the teeth 170 resist the downward motions of the first ungearing surfaces 134 in the direction of arrow X, causing the cam arms 26 to pull the pivot posts 30, and thus the rotational axis 36, further vertically upward in the direction of arrow Y. As the pivot posts 30 are pulled upward, the harness connector 18 is in turn pulled further upward with enough force to overcome the dynamic friction between the mating electrical contacts and thus fully disengage the electrical contacts. Also, as the lever member 14 is further rotated about the rotational axis 36 in the direction of arrow W, the handle 110 passes over, and deflects downward in the direction of arrow X, the stop wedge 194, which extends back out of the top portion 20 when the handle 110 no longer contacts the stop wedge 194.

Figure 11:
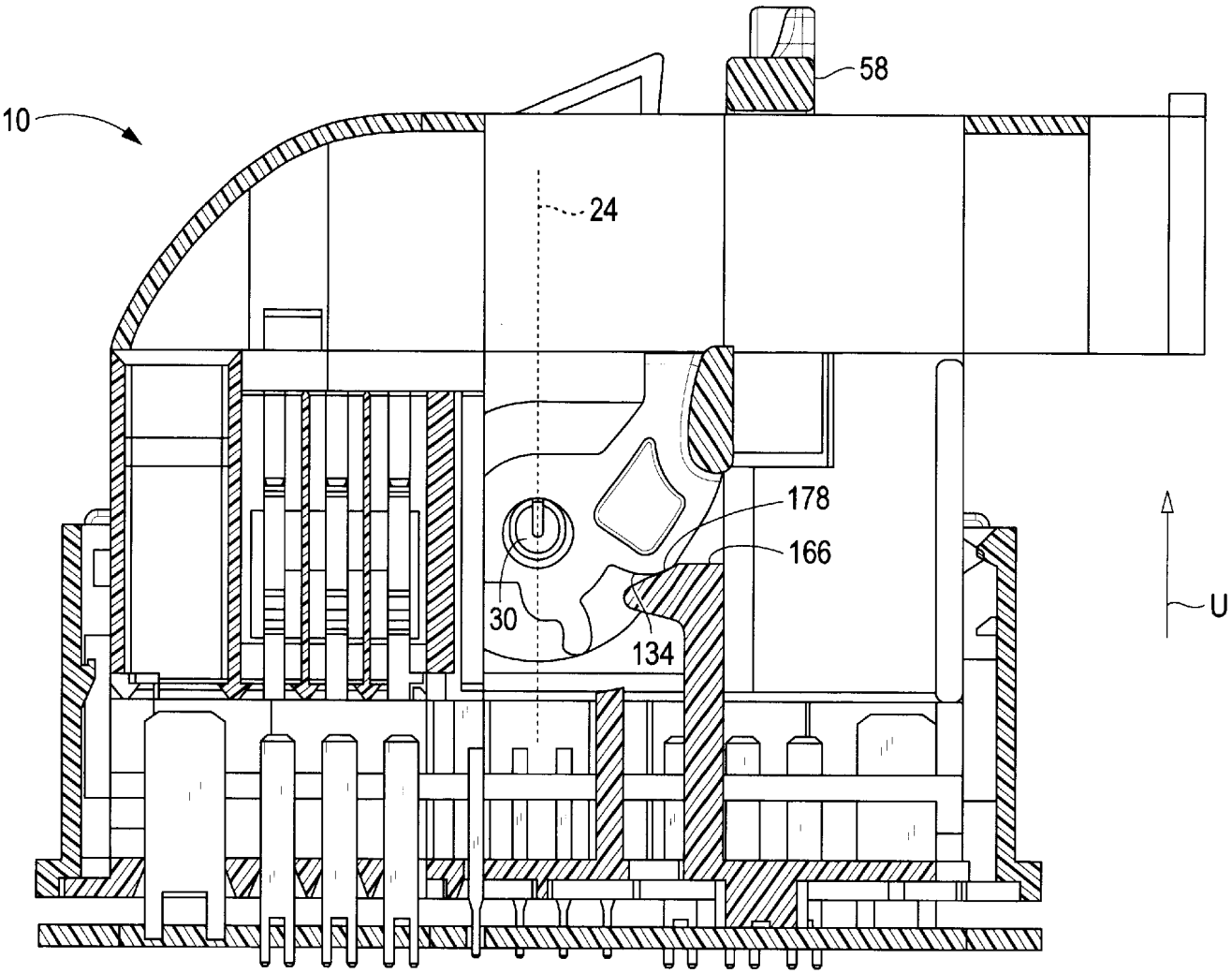
FIG. 11 illustrates a cutaway side view of the mate assist assembly of FIG. 1 in a final unmating stage.

FIG. 11 illustrates a cutaway side view of the mate assist assembly 10 of FIG. 1 in a final unmating stage. The lever arms 58 are once again parallel to the vertical axis 24. As the first ungearing surfaces 134 engaged the top portions 178 and the pivot posts 30 were moved vertically upward in the direction of arrow U, the first ungearing surfaces 134 slid along the top portions 178 toward the top surfaces 166.

Returning to FIG. 8, the top portions 178 meet the bottom portions 182 at tips 250. When the mate assist assembly 10 is fully mated, the tips 250 are a distance D4 from the rotational axis 36. As the rotational axis 36 is moved vertically upward in the direction of arrow Z, the distance D4 shortens so that the first ungearing surfaces 134 are in a rotational range to contact the top portions 178 as the first ungearing surfaces 134 rotate toward the top portions 178. If the rotational axis 36 did not move vertically upward closer to the tips 250, the first ungearing surfaces 134 would only laterally touch the tips 250 and no vertical forces would be created.

Therefore, the second ungearing surfaces 142, which have a pitch radius D2 (FIG. 9) that is shorter than the pitch radius D1 (FIG. 10) of the first ungearing surfaces 134, travel a first short distance to contact the release posts 50 and push the rotational axis 36 vertically upward so that the first ungearing surfaces 134 travel a second long distance to complete the unmating process without need of second cam gears engaging the teeth 170.

The mate assist assembly confers several benefits. First, because first ungearing surfaces and the gearing surfaces have a different pitch radius than the second ungearing surfaces, only one gear tooth is needed on each cam arm to engage the mating posts and the release posts in order to lift and lower the harness connector within the module connector. Thus the cam arms are easier to manufacture. Secondly, the ungearing surfaces provide enough vertical force to easily disengage the contacts. The second ungearing surfaces travel a short distance to engage the release posts and push down against the release posts with enough force to overcome the static friction of the mated contacts. When the second ungearing surfaces no longer vertically engage the release posts, the first ungearing surfaces engage the mating post with enough force to overcome the dynamic friction between the contacts and thus disengage the contacts.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector comprising:

first and second housings having ends configured to receive electrical contacts, said first and second housings having front ends configured to be matable with one another to join corresponding electrical contacts, said first and second housings being movable between initial and final positions, at which corresponding electrical contacts partially and fully mate, respectively;

a lever member engaging said first and second housings and moving said first and second housings between said initial and final positions as said lever member is rotated through a range of motion about a rotational axis, said lever member including at least one cam arm having a retention aperture to engage said first housing and having first and second gear surfaces configured to engage said second housing; and first and second mating posts mounted within an interior region of said second housing, said first mating post engaging said first gear surface at a first distance from said rotational axis as said lever member is rotating through said range of motion to move said first and second housings toward said final position, said second mating post engaging said second gear surface at a second distance from said rotational axis as said lever is rotating an opposite direction through said range of motion to move said first and second housings toward said initial position, said first and second distances being different.

2. The electrical connector of claim 1, wherein said at least one retention aperture rotatably engages a pivot post extending from exterior side walls of said first housing.

3. The electrical connector of claim 1, wherein said first gear surface is along a wall within a notch formed in a peripheral surface of said cam arm, said first gear surface configured to engage a bottom portion of said first mating post.

4. The electrical connector of claim 1, wherein said second gear surface is along a wall within a notch formed in a peripheral surface of said cam arm.

5. The electrical connector of claim 1, wherein said mating post includes a cam tooth, said cam tooth engaging said first gear surface.

6. The electrical connector of claim 1, wherein said second housing includes insertion posts interiorly positioned within said second housing configured to be received by corresponding apertures interiorly positioned within said first housing as said first and second housings are moved from said initial position to said final position.

7. The electrical connector of claim 1, wherein said lever member extends from opposite exterior side walls of said first housing between opposite interior side walls of said second housing from which extends opposing said first and said second mating posts, said cam arm rotating between and engaging opposing said first and second mating posts.

8. The electrical connector of claim 1, wherein said cam arm includes a third gear surface opposite said first gear surface along a notch formed in a peripheral surface of said cam arm, said third gear surface configured to engage a top surface of a tooth of said first mating post at a third distance from said rotational axis as said lever is rotating through said range of motion to move said first and second housings toward said initial position, said third distance different from said first and said second distances.

9. An electrical connector comprising:

first and second housings having ends configured to receive electrical contacts, said first and second housings having front ends configured to be matable with one another to join corresponding electrical contacts, said first and second housings being movable between initial and final positions, at which corresponding electrical contacts partially and fully mate, respectively;

a lever member engaging said first and second housings and moving said first and second housings between said initial and final positions as said lever member is rotated through a range of motion about a rotational axis, said lever member including at least one cam arm having a retention aperture to engage said first housing and first and second unmating surfaces configured to engage said second housing; and first and second mating posts mounted within an interior region of said second housing, said first mating post configured to engage said first unmating surface a first distance from said rotational axis as said lever member is rotating through said range of motion to move said first and second housings to said initial position, said second mating post configured to engage said second unmating surface a second distance from said rotational axis as said lever is rotating through said range of motion to move said first and second housings to said initial position, said first and second distances being different.

10. The electrical connector of claim 9, wherein said at least one retention aperture rotatably engages a pivot post extending from exterior side walls of said first housing.

11. The electrical connector of claim 9, wherein said first unmating surface is along a wall within a notch formed in a peripheral surface of said cam arm, said first unmating surface configured to engage a top portion of said first mating post.

12. The electrical connector of claim 9, wherein said second unmating surface is along a wall within a notch formed in a peripheral surface of said cam arm.

13. The electrical connector of claim 9, wherein said mating post includes a cam tooth, said cam tooth engaging said first unmating surface.

14. The electrical connector of claim 9, wherein said second housing includes three insertion posts interiorly positioned within said second housing configured to be received by three corresponding apertures interiorly positioned within said first housing as said first and second housings are moved from said initial position to said final position.

15. The electrical connector of claim 9, wherein said lever member extends from opposite exterior side walls of said first housing between opposite interior side walls of said second housing from which extends opposing said first and said second mating posts, said cam arm rotating between and engaging opposing said first and second mating posts.

16. The electrical connector of claim 9, wherein said cam arm includes a first mating surface opposite said first unmating surface along a notch formed in a peripheral surface of said cam arm, said first mating surface configured to engage a bottom surface of a tooth of said first mating post a third distance from said rotational axis as said lever is rotating through said range of motion to move said first and second housings to said final position, said third distance different from said first and said second distances.

17. An electrical connector comprising:

first and second housings having ends configured to receive electrical contacts, said first and second housings having front ends configured to be matable with one another to join corresponding electrical contacts, said first and second housings being movable between initial and final positions, at which corresponding electrical contacts partially and fully mate, respectively;

a lever member engaging said first and second housings and moving said first and second housings between said initial and final positions as said lever member is rotated through a range of motion about a rotational axis, said lever member including at least one cam arm having a retention aperture to engage said first housing and first, second, and third gear surfaces engaging said second housing; and at least one set of first and second mating posts mounted within an interior region of said second housing, said first mating post having a tooth configured to engage said first gear surface a first distance from said rotational axis as said lever member is rotating through said range of motion to move said first and second housings to said final position, said tooth configured to engage said second gear surface a second distance from said rotational axis as said lever member is rotating through said range of motion to move said first and second housings to said initial position, said second mating post configured to engage said third gear surface a third distance from said rotational axis as said lever is rotating through said range of motion to move said first and second housings to said initial position, said first, second, and third distances being different.

18. The electrical connector of claim 17, wherein said at least one retention aperture rotatably engages a pivot post extending from exterior side walls of said first housing.

19. The electrical connector of claim 17, wherein said first gear surface is along a wall opposite said second gear surface within a notch formed in a peripheral surface of said cam arm, said first gear surface configured to engage a bottom portion of said first mating post.

20. The electrical connector of claim 17, wherein said first gear surface is along a wall opposite said second gear surface within a notch formed in a peripheral surface of said cam arm, said second gear surface configured to engage a top portion of said first mating post.

21. The electrical connector of claim 17, wherein said first gear surface is along a wall opposite said second gear surface within a first notch formed in a peripheral surface of said cam arm, said third gear surface is along a wall within a second notch formed in a peripheral surface of said cam arm adjacent to said first notch and configured to engage a top portion of said second mating post.

22. The electrical connector of claim 17, wherein said first mating post includes a cam tooth, said cam tooth having a top portion configured to engage said second gear surface and a bottom portion configured to engage said first gear surface.

23. The electrical connector of claim 17, wherein said second housing includes three insertion posts interiorly positioned within said second housing configured to be received by three corresponding apertures interiorly positioned within said first housing as said first and second housings are moved from said initial position to said final position.

24. The electrical connector of claim 17, wherein said lever member extends from opposite exterior side walls of said first housing between opposite interior side walls of said second housing from which extends opposing said first and said second mating posts, said cam arm rotating between and engaging opposing said first and second mating posts.

* * * * *